US005271188A

United States Patent [19]

Yoshikawa

[11] Patent Number: 5,271,188

[45] Date of Patent: Dec. 21, 1993

[54] POWDER BLASTING APPARATUS

[75] Inventor: Takashi Yoshikawa, Kanagawa, Japan

[73] Assignee: Sony Corporation, Japan

[21] Appl. No.: 876,746

[22] Filed: Apr. 28, 1992

[30] Foreign Application Priority Data

May 17, 1991 [JP] Japan ..... 3-140794

[51] Int. Cl.[5] ..... B24C 3/08

[52] U.S. Cl. ..... 51/417; 51/421; 51/424; 51/439; 51/319

[58] Field of Search ..... 51/417, 421, 424, 425, 51/426, 428, 436, 438, 439, 317-320, 326, 427, 418, 420

[56] References Cited

U.S. PATENT DOCUMENTS

| | | | |
|---|---|---|---|
| 2,195,810 | 4/1940 | Bower | 51/14 |
| 3,604,157 | 9/1971 | Fogle | 51/417 |
| 4,738,056 | 4/1988 | Suzuki | 51/413 |
| 4,783,904 | 11/1988 | Kimura | 29/786 |
| 5,182,882 | 2/1993 | Brodene et al. | 51/319 |

*Primary Examiner*—Bruce M. Kisliuk
*Assistant Examiner*—Eileen P. Morgan
*Attorney, Agent, or Firm*—Ronald P. Kananen

[57] ABSTRACT

Described herein is a powder blasting apparatus for abrasion treatments, which is capable of treating a number of works concurrently and progressively with blasts of a high pressure gas and fine powder mixture in an efficient manner to shorten the so-called tact time.

The powder blasting apparatus is provided with a plural number of work tables 21 to 23 arrayed at uniform intervals in the longitudinal direction of the apparatus for reciprocating movements between first and second stop positions. Blast nozzles 38 to 40 are located between the first and second stop positions of the respective work tables to blast a mixture of high pressure compressed air and fine powder against a work on each one of the work tables simultaneously for an etching, boring or piercing treatment. Work transfer heads 48 and 49 are located in a position corresponding to the second stop position of a first one of two adjacently located work tables or the first stop position of the other or second work table to pick up a work on the first work table at the second stop position and place the work on the second work table at the first stop position, thereby successively transferring the work to a forwardly located work table while subjecting same progressively to abrasion treatments by the respective blast nozzles.

11 Claims, 15 Drawing Sheets

POWDER BLASTING APPARATUS

BACKGROUND OF THE INVENTION

1. Field of the Art

This invention relates to an apparatus for giving a workpiece (hereinafter referred to simply as "work" for brevity) on a work table progressive abrasion treatments with blasts of a mixture of fine powder and high-pressure gas or air, for example, in a surface etching process or in a grinding operation or in a boring or piercing operation.

More particularly, the invention concerns a novel apparatus for abrasion treatments with blasts of fine powder mixture, which is capable of treating a number of works concurrently and progressively with blasts of powder and compressed air mixture in a predetermined sequence to shorten the so-called tact time.

2. Description of the Prior Art

The powder blasting machines, which are arranged to blast mixture powder of metal and inorganic material or the like against a work with aid of a high pressure gas, have been known and used in the art as means for grinding or boring or perforating a workpiece, for example, as means for forming fine blind holes or through holes in substrates of electronic devices.

The machines of this sort are basically constituted by a work table adapted to hold a work thereon, a transfer means for loading and ejecting the work onto and from the work table, a nozzle for blasting a powder mixture toward the work, a powder feed means for supplying high-pressure compressed air and powder mixture to the nozzle, a powder recovery means for collecting spent powder mixture which has been used for the powder blasting treatment, and an air compressor serving as a compressed air source. In this instance, the work is masked except for those areas where blind or through holes are to be formed, so that, as the powder mixture is blasted- against the work, blind or through holes are formed in predetermined positions on the work.

For example, as mentioned above, the holes to be formed on a substrate include two types of holes, i.e., a through hole which is open on the opposite sides of the substrate and a blind hole which is open only on one side of the substrate. In this regard, it is often the case that, in addition to through holes, a variety of blind holes of different depths need to be formed on each substrate.

In order to form a variety of holes on a substrate by the use of a single blast nozzle, it becomes necessary to blast the mixture powder against predetermined areas of the work for different time periods depending upon the type of holes to be formed, namely, over a relatively short time period for a shallow blind hole, over a prolonged time period for a deeper blind hole and over a further prolonged time period for a through hole, taking an objectionably long time in forming various holes into each substrate.

This problem is accompanied by another problem that, in the production line of substrates, the overly time consumption in the boring or perforating stage causes stagnation of works in other stages of the production line, resulting in a lengthy tact time throughout the line.

SUMMARY OF THE INVENTION

It is therefore a primary object of the present invention to provide a powder blasting apparatus for abrasion treatments, which is suitably arranged to overcome the above mentioned problems.

In accordance with the present invention, for achieving the above-stated objective, there is provided a powder blasting apparatus for abrasion treatments, which essentially includes: a plural number of work tables arrayed at uniform intervals in the longitudinal direction of the apparatus and arranged to releasably hold a work thereon independently of each other; a work table feed means arranged to reciprocate the work tables simultaneously in the longitudinal direction between first and second stop positions across a distance corresponding to the intervals between the work tables; blast nozzles each arranged to blast a mixture of high pressure gas and fine powder against a work on a confronting work table at a position between the first and second stop positions; and a work transfer means arranged to pick up a work on a first one of two adjacent work tables and to place the work on the other or second work table; the work transfer means being located in a position corresponding to the second stop position of the first work tables as well as to the first stop position of the second work tables; the blast nozzles being located between the first and second stop positions of the respective work tables; the powder blasting machine being adapted to operate in a sequence of loading a work on the first work table at the first stop position, feeding the work tables forward from the first to second stop position by the work table feed means while subjecting the work to an abrasion treatment with blasts of powder mixture from a blast nozzle at a mid point between the first and second stop positions, picking up the work off the first work table by the work transfer means at the second stop position, placing the work on the second work table as soon as the work tables are returned to the first stop position, and feeding the work tables again toward the second stop position while subjecting the work to another abrasion treatment at a point intermediate between the first and second stop positions, thereby transferring the work successively to adjacently located tables while subjecting same successively and progressively to different abrasion treatments by the respective blast nozzles.

Thus, the powder blasting apparatus of the invention is arranged to carry out a number of blast-abrasion treatments concurrently and separately through the respective blast nozzles which are operated under different conditions, for example, with regard to blasting time or range, nature of blasting powder mixture composition, blast pressure etc. By suitably setting these operational factors, a variety of holes can be formed on a substrate substantially concurrently. Besides, after feeding untreated substrates to the powder blasting apparatus, treated substrates with predetermined bores and perforations are ejected one after another at the same time intervals as the timing of work transfer by the work transfer means. It follows that the substrates finished with the blast-abrasion treatment can be produced in the same timing, shortening the so-called tact time to a marked degree.

The above and other objects, features and advantages of the invention will become apparent from the following description and the appended claims, taken in conjunction with the accompanying drawings which show by way of example a preferred embodiment of the invention.

DESCRIPTION OF PREFERRED EMBODIMENTS

Figure 1:
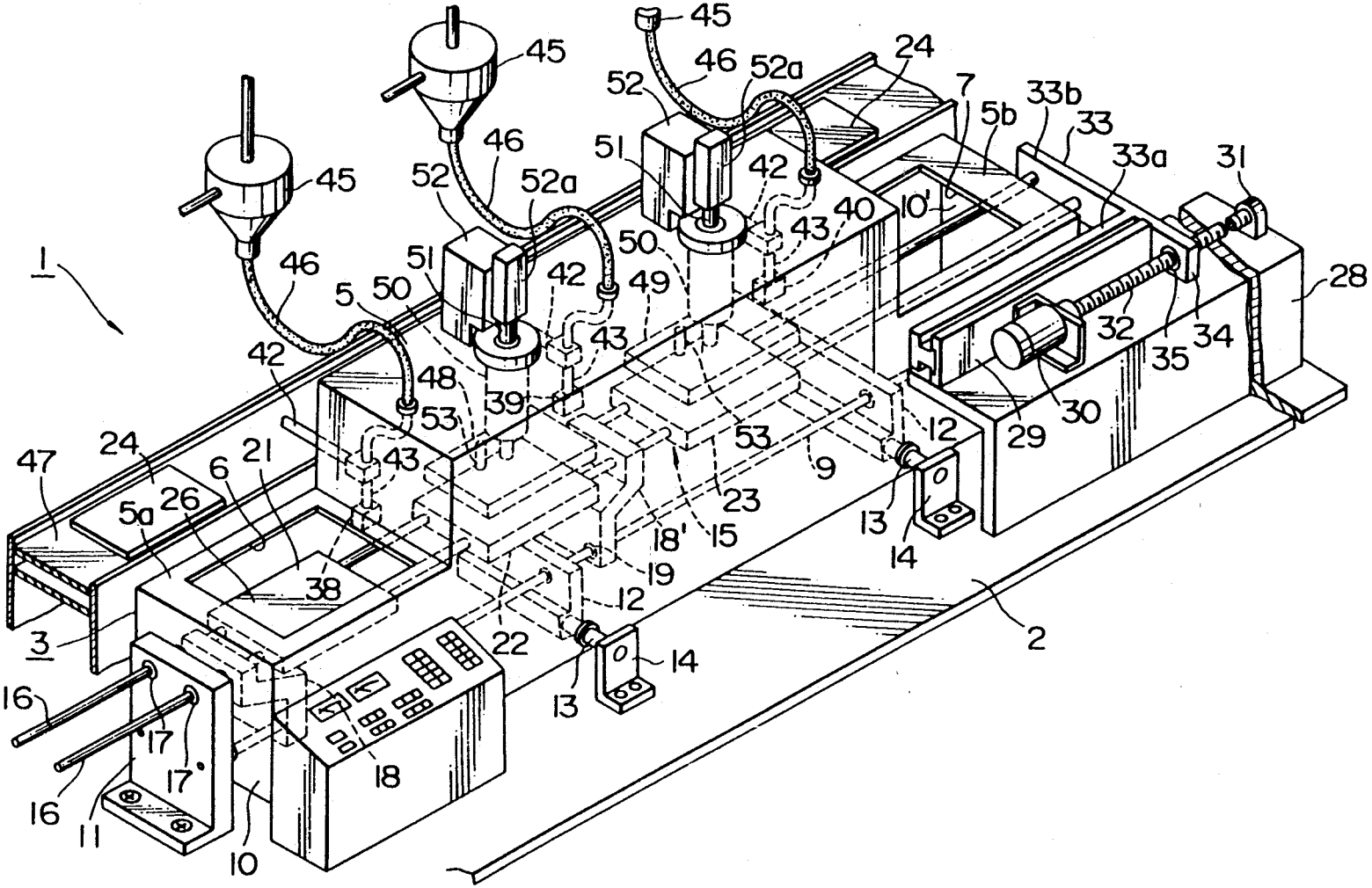
FIG. 1 is a perspective view of a powder blasting apparatus embodying the present invention.

Hereafter, the powder blasting apparatus according to the invention is described more particularly by way of a preferred embodiment shown in the drawings.

In the drawings, the reference numeral 2 denotes the base of the powder blasting apparatus.

Indicated at 3 is a treating compartment which houses therein three work tables together with blast nozzles and a couple of transfer heads which will be described hereinlater. The treating compartment 3 is formed in a shape which is elongate in the direction of work transfer (in the direction from the lower left corner to the upper right corner of FIG. 1, which will be hereinafter referred to as "longitudinal direction", and the sides of the treating compartment 3 facing the lower right corner and the upper left corner of FIG. 1 will be referred to as "front side" and "rear side", respectively, for the convenience of explanation), and its height is reduced in its longitudinal end portions substantially to ½ of its center portion. In its bottom wall 4, the treating compartment 3 is provided with three relatively shallow funnel-like portions 4*a* in series in the longitudinal direction, each one of the flannel-like portions 4*a* being converged toward a bottom end and provided with a suction port 4*b*.

The treating compartment 3 is supported on a machine frame which is provided on the base 2 although not shown in the drawing.

A work entrance 6 of substantially rectangular shape is opened in the top wall 5 in one longitudinal end portion 5*a* of the treating compartment 3, while a work exit 7 substantially of the same size as the work entrance 6 is opened in the opposite longitudinal end portion 5*b*. These work entrance 6 and exit 7 are openably closed by lids 8 and 8', respectively.

Indicated at 9 are guide shafts for movably supporting a transfer block which will be described later, the guide shafts 9 being extended in parallel relation with each other at a level close to the bottom wall of the treating compartment 3 and passed longitudinally through end walls 10 and 10' of the treating compartment 3. The guide shafts 9 are separately supported on bearing walls 11, which are erected on the base 2, at their opposite ends which are disposed outside the treating chamber 3, and on intermediate support walls 12, which are provided within the treating compartment 3, at their intermediate portions which are spaced from each other toward one or the other end of the treating chamber 3. As a result, despite their relatively lengthy form, the guide shafts 9 are supported substantially free of flexure.

The intermediate support walls 12 are supported on stays 13 which are extended transversely across the treating compartment 3. The opposite ends of the stays 13 are separately supported on support members 14 which are fixed to the base 2 outside the treating compartment 3.

The reference numeral 15 denotes a transfer block which is constituted by a couple of slide shafts, three work tables which are fixed on the slide shafts, and a couple of guided plates for moving the just-mentioned slide shafts along the guide shafts 9.

Indicated at 16 are the slide shafts which are longer than the length of the treating compartment 3 to some extent and which are parallelly extended through the treating compartment 3 in the longitudinal direction under the work entrance 6 and exit 7 and above the afore-mentioned guide shafts 9. These slide shafts 16 are slidably fitted in bores 10*a* and 10*a*' formed in the end walls 10 and 10' of the treating compartment and ball guides 17 mounted on the bearing walls 11.

Designated at 18 and 18' are guided plates which are formed substantially in a crank shape and fixed at their upper ends to the slide shafts 16 at two positions, i.e., at a position close to one longitudinal ends of the slide shafts 16 and at an intermediate position closer to the other ends of the slide shafts 16. Each of the guide plates 18 and 18' is provided with a couple of ball guides 19 in a lower end portion in transversely spaced positions to slidably receive the guide shafts 9 therein.

Accordingly, the slide shafts 16 are slidably supported on the bearing walls 11 through the ball guides 17 and at the same time on the guided plates 18 and 18' through the ball guides 19 for sliding movements in the longitudinal direction.

Indicated at 20 are bellow hoses which are fitted around the guide shafts 9 and which have the opposite ends thereof separately fixed to the end wall 10 and the guided plate 18 on the entrance side of the treating compartment 3, to the other guided plate 18' and the intermediate support wall 12 on the entrance side, to the intermediate support wall 12 on the entrance side and the guided plate 18' on the exit side, to the guided plate 18' and the intermediate support wall 12 on the exit side, and to the intermediate support wall 12 and the end wall 10' on the exit side, respectively, thereby covering the guide shafts 9 and ball guides 19 to prevent their exposure within the treating compartment 3.

The reference numerals 21 to 32 denote work tables on which substrates are to be separately mounted. The work tables 21 to 23 are same in size and fixed on the slide shafts 16 at uniform intervals in the longitudinal direction.

More specifically, the work table 21 (hereinafter referred to as "first work table") on the entrance side is fixed on the slide shafts 16 at a position inward of and close to the guided plate 18 on the entrance side, the middle work table 22 (hereinafter referred to as "second work table") is fixed in a position close to the entrance side of the guided plate 18', and the work table 23 (hereinafter referred to as "third work table") is fixed in a position close the exit side of the guided plate 18'.

Therefore, as the slide shafts 16 are moved back and forth in the axial direction, the three work tables 21 to 23 are simultaneously and integrally moved in the longitudinal directions.

The work tables 21 to 23 are same in shape and construction, so that one work table alone is described in detail below, simply designating similar component parts of other work tables by similar reference numerals or characters to avoid repetitions.

The work table 21 is constituted by a rectangular, relatively flat box-like base structure 25 which is open on the top side, and a work mounting plate 26 of urethane rubber covering the opening on the top side of the base structure 25 and provided with a multitude of air holes **26*a***.

The work table 21 is internally applied with a negative or positive pressure by means of a pressure regulator means which is not shown. When a substrate 24 is placed on the table, a negative pressure is applied thereto to hold the substrate 24 in position on the table by suction force, and, when no work is on the table, a slight positive pressure is applied to prevent intrusion of fine powder particles into the inner space of the work table 21.

Indicated at 27 are powder collecting hoods each in the form of a relatively flat inverted pyramid shape (shown only in FIG. 2), which are each fixed on the slide shafts 16 in an upper end portion in such a way as to isolate the work tables 21 to 23 from each other.

The reference numeral 28 denotes a motor base which is fixed on the base 2 at a position forward of the exit end of the treating compartment 3. A longitudinal guide rail 29 is fixed on the top surface of the motor base 28 along the inner side thereof, and a pulse motor 30 and a pillow block 31 are fixedly mounted in longitudinally spaced positions on the outer side of the guide rail 29. The rotational shaft of the pulse motor 30 is coupled with one end of a ball screw 32 which is rotatably supported on the pillow block 31 at the other end.

Designated at 33 is a moving member of L-shape in plan view, including a longitudinally extending portion **33*a* (hereinafter referred to as "guided portion") which is slidably engaged with the guide rail 29, and a transversely extending portion 33*b* (hereinafter referred to as "fixed portion") which is located on the outer side of the exit end of the treating compartment 3 and fixed to the protruded ends of the slide shafts 16**.

Denoted at 34 is a link plate which is projected forward from the fixed portion **33*b* of the moving member 33 and fitted with a nut 35 (FIG. 1) in threaded engagement with the ball screw 32**.

Thus, as the ball screw 32 is rotated by the pulse motor 30, the nut 35 is fed forward or backward along the ball screw 32 to move the moving member 33 and slide shafts 16 forward or backward in the longitudinal direction together with the transfer block 15.

Figure 2:
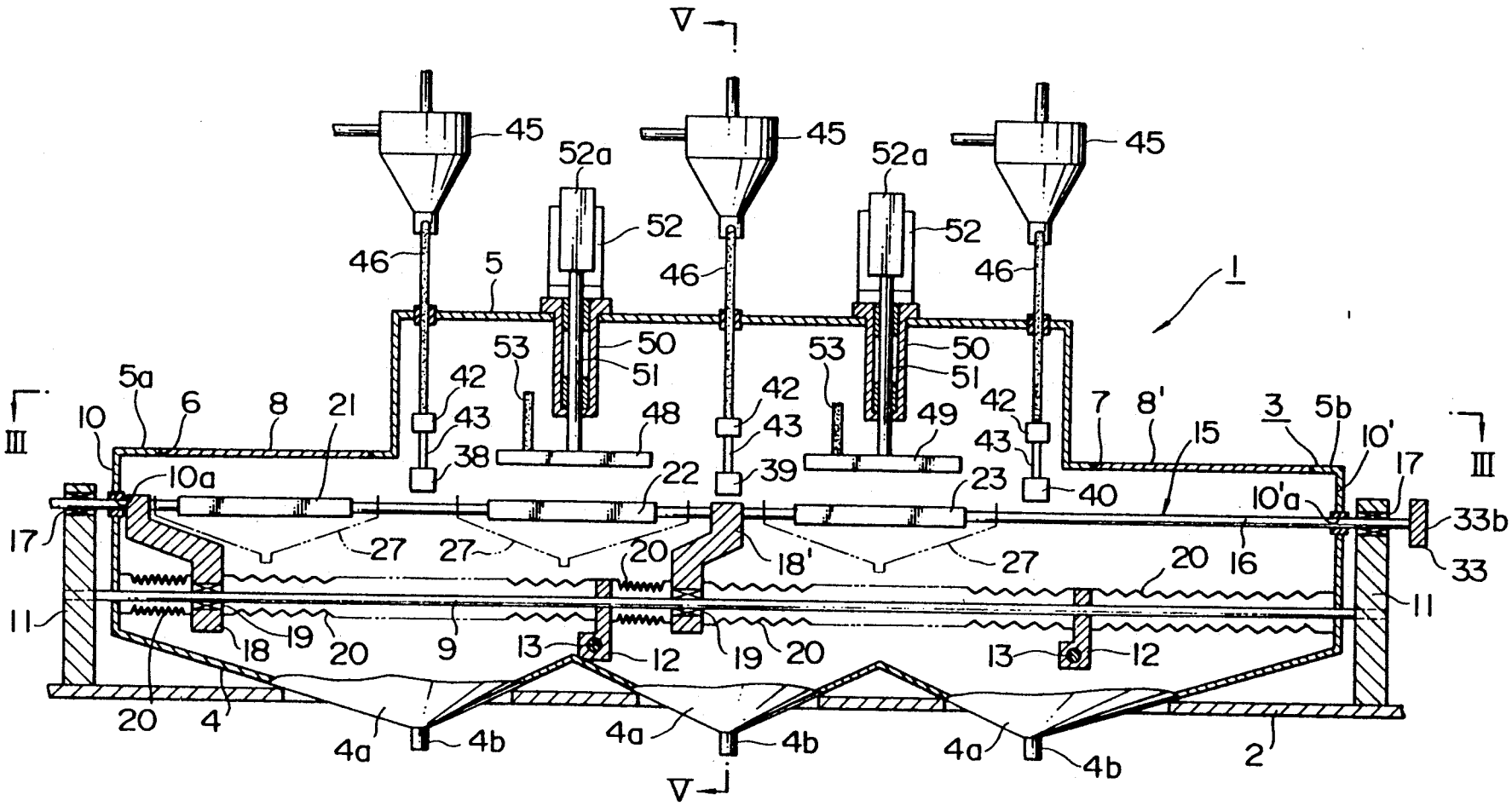
FIG. 2 is a vertical section of the powder blasting apparatus.
Figure 3:
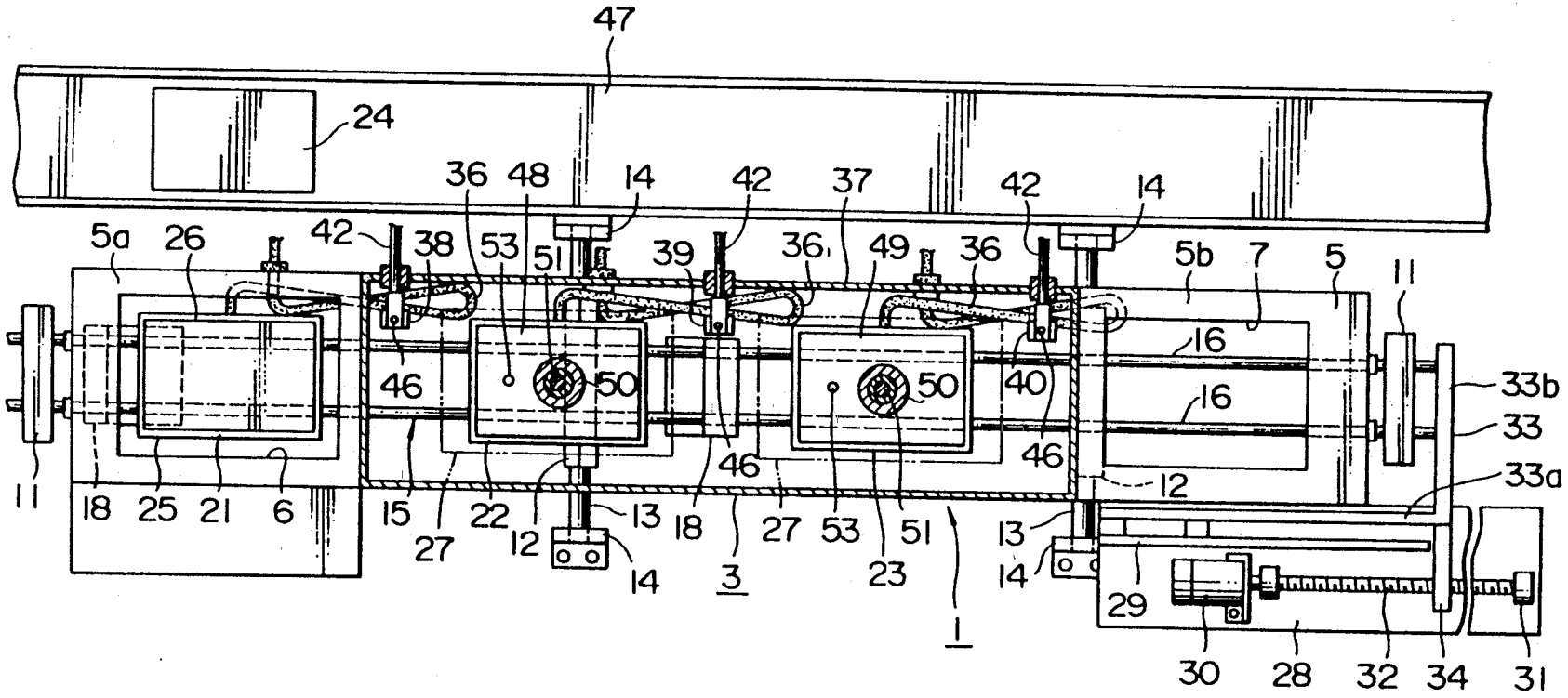
FIG. 3 is a sectional view taken on line III—III of FIG. 2.
Figure 4:
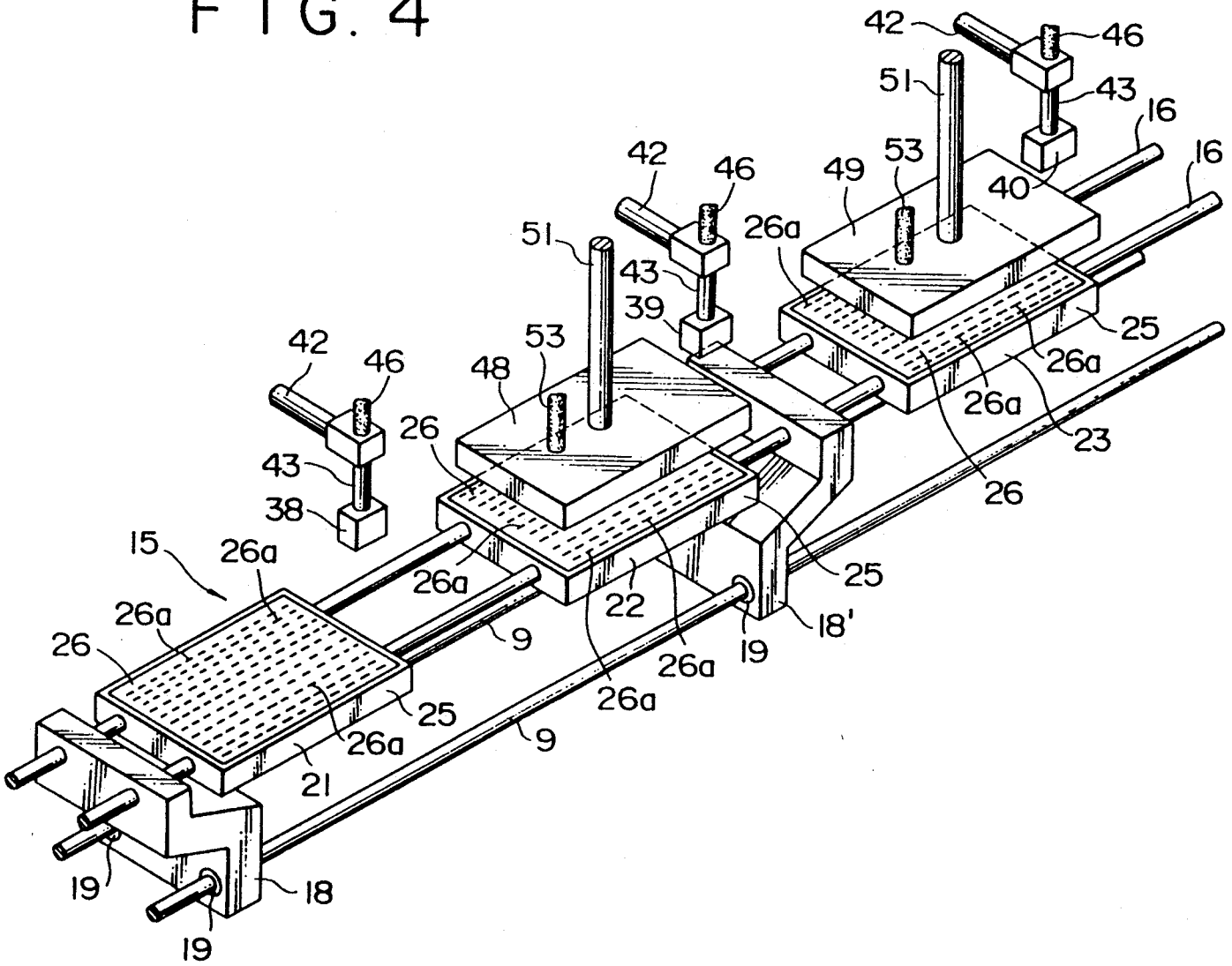
FIG. 4 is an enlarged perspective view of major component parts of the apparatus.

The transfer block 15 is intermittently reciprocated between a first stop position where the first work table 21 is located immediately under the work entrance 6 as shown particularly in FIG. 2 and a second stop position where the third work table 23 is located immediately under the work exit 7. The distance of this reciprocating movement of the transfer block 15 is identical with the pitch of the array of the work tables 21 to 23 on the slide shafts 16. Therefore, the first stop positions of the work tables 22 and 23 correspond to the second stop positions of the work tables 21 and 22, respectively.

Indicated at 36 are flexible air hoses which are introduced into the treating compartment 3 through holes in the rear wall 37 of the treating compartment 3, each one of the air hoses 36 being connected at one end to one of cylindrical connector members which are rearwardly projected from the back side of the work tables 21 to 23 to communicate the air hoses with the internal spaces of the work tables 21 to 23, respectively. At the other end, each flexible air hoses 36 is separately connected to a pressure regulator means which is not shown.

Each air hose 36 within the treating compartment 3 has a length which is sufficient enough for ensuring unobstructed movements of the work tables 21 to 23.

Figure 6:
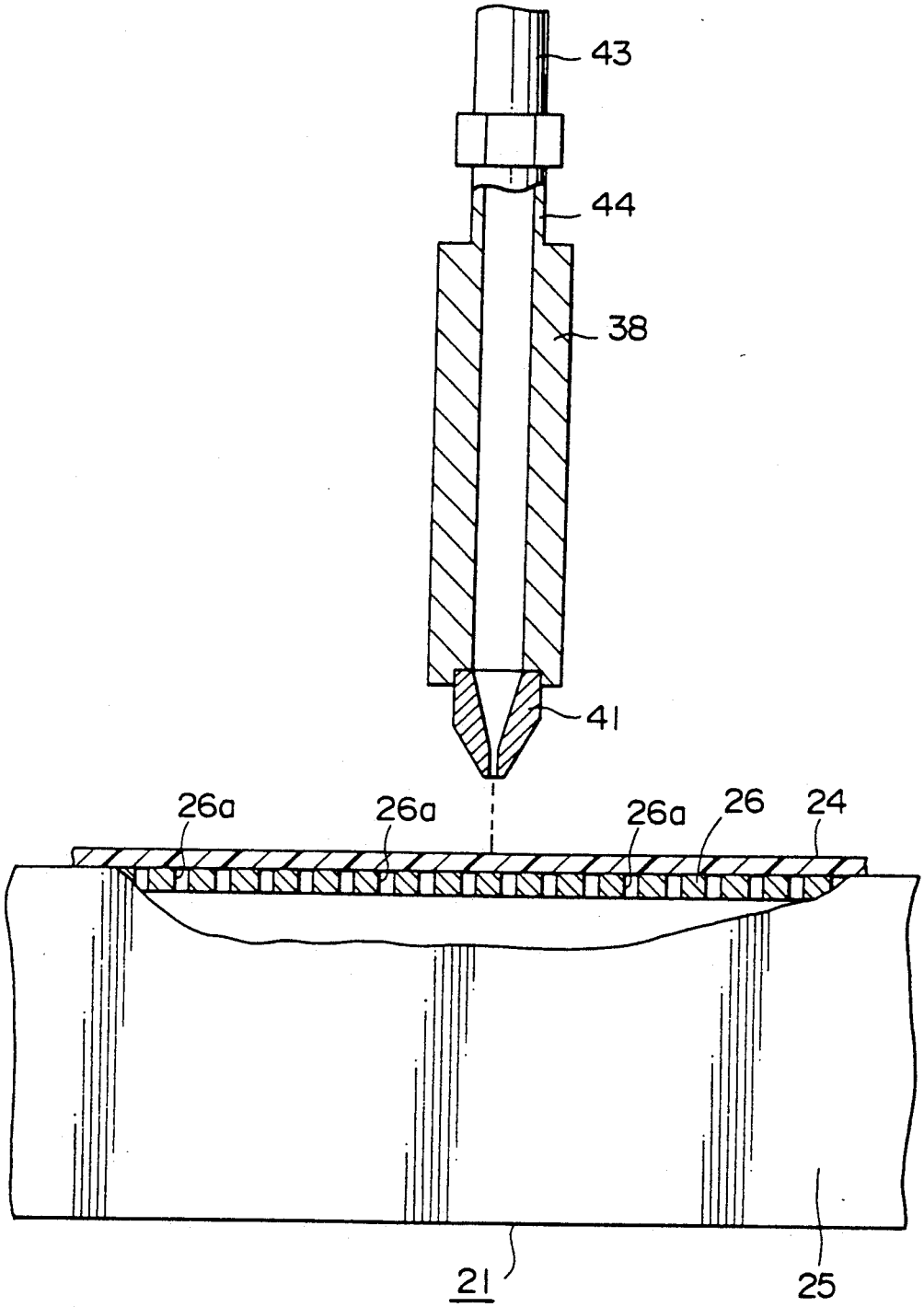
FIG. 6 is an enlarged sectional view of a work table and a blast nozzle.
Figure 7:
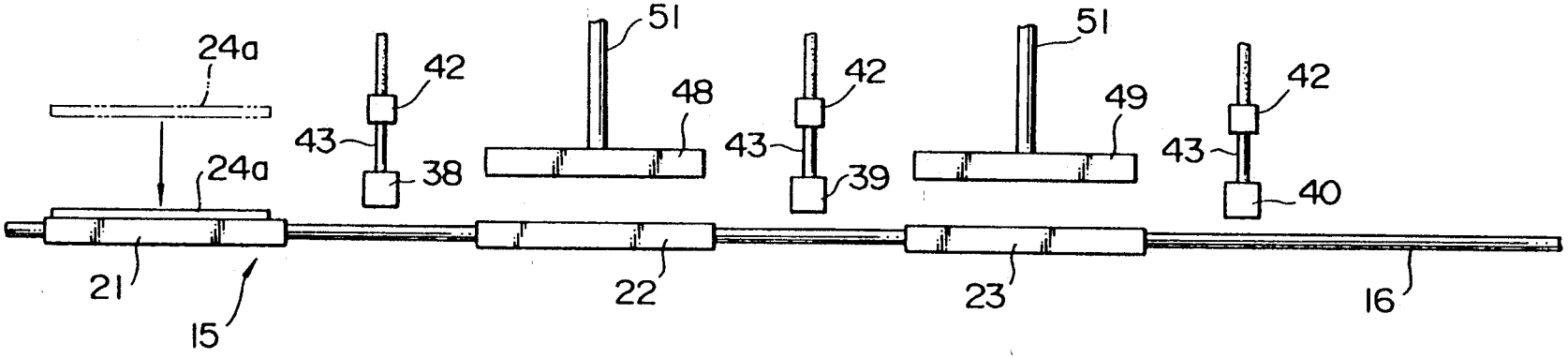
FIG. 7 is a diagrammatic front view of major components in an initial phase of operation of the powder blasting apparatus of the invention, preceding the operational phases shown in FIGS. 8 through 14.

The reference numerals 38 to 40 indicate blast nozzles which spurt blasts of powder mixture toward the substrates 24. These blast nozzles 38 to 40 are substantially in the form of a downwardly opened box, which has a smaller width in the transverse direction than its length in the longitudinal direction of the apparatus, and are each provided with a nozzle tip 41 at the lower open end. Each one of the nozzle tips 41 on the blast nozzles 38 to 40 has a longitudinally extending spout mouth (one nozzle tip is shown in FIG. 6).

Indicated at 42 are transversely extending, retractable nozzle support shafts (shown only partly in the drawings) which are separately extended into the treating compartment 3 through holes in the rear wall 37 from three nozzle drives located behind the treating compartment 3.

Fixed on the fore ends of these nozzle support shafts 42 are connector pipes 43 which are connected at their lower ends to pipe joints 44, which are projected upward from the blast nozzles 38 to 40, respectively. Thus, the three blast nozzles 38 to 40 are separately supported on the transversely retractable nozzle support shafts 42 within the treating compartment 3.

The spout mouths of the nozzle tips 41 on the three blast nozzles 38 to 40 are located at a level slightly higher than the top surfaces of the work tables 21 to 23. When the transfer block 15 is in the afore-mentioned first stop position, the blast nozzle 38 on the side of the work entrance (hereinafter referred to as "first blast nozzle") is located in an intermediate position between the first and second work tables 21 and 22, the middle blast nozzle 39 (hereinafter referred to as "second blast nozzle") is located in an intermediate position between the second and third work tables 22 and 23, and the blast nozzle 40 on the side of the work exit (hereinafter referred to as "third blast nozzle") is located in an intermediate position slightly forward of the third work table 23. The two adjacent blast nozzles 38 and 39 or 39 and 40 are spaced from each other at the same intervals as the work tables 21 to 23.

Figure 5:
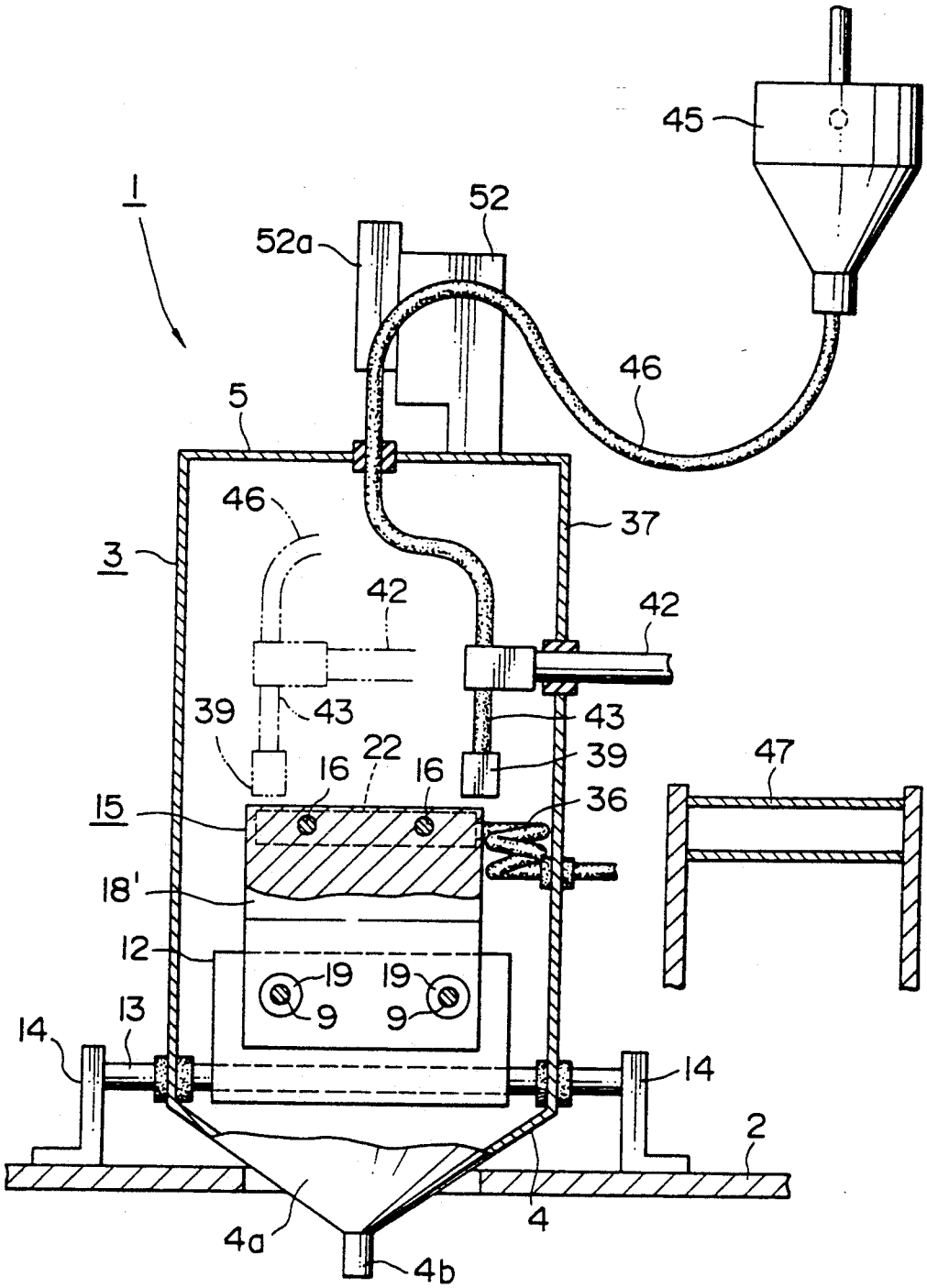
FIG. 5 is an enlarged sectional view taken on line V—V of FIG. 2.

As the nozzle support shafts 42 are moved back and forth in the transverse direction by nozzle drive mechanisms which are not shown, the blast nozzles 38 to 40 are moved between a retracted position where they are confronted by rear end portions of the work tables 21 to 23 as indicated by solid line in FIG. 5 and an advanced position where they are confronted by fore end portions of the work tables 21 to 23 as indicated by two-dot chain line in the same figure.

Denoted at 45 are mixing tanks which are supported on a machine frame (not shown) substantially in uniformly spaced positions in the longitudinal direction, the mixing tanks 45 being quantitatively supplied with mixture powder to be mixed with compressed air from air compressors which will be described later.

Indicated at 46 are flexible air feed tubes which are extended into the treating compartment 3 from the lower ends of the mixing tanks 45 through holes in the top wall 5 and separately connected to the connector pipes 43.

The powder which has been mixed with compressed air in the mixing tanks 45 is supplied to each of the blast nozzles 38 to 40 through the air feed tubes 46 and connector pipes 43, and separately spurted out through the blast nozzles 38 to 40 in a strip-like shape having its length in the longitudinal direction of the apparatus.

Although omitted in the drawings, a fluid valve is inserted in each of the air feed tubes 46 outside the treating compartment 3, thereby permitting to control the powder feed rates to the respective blast nozzles 38 to 40 separately by opening or closing the corresponding fluid valves.

Designated at 47 is a work conveyer belt which is extended in the longitudinal direction along the rear side of the treating compartment 3, thereby to transfer untreated substrates 24 one after another to a point near the work entrance of the powder blasting apparatus 1 and sending forward treated substrates 24 with blind and through holes to a next station of the production line.

A substrate 24 which has been delivered to a position immediately behind the work entrance 6 of the treating compartment 3 is then picked up from the conveyer belt 47 by a transfer robot, not shown, and placed on the first work table 21 of the transfer block 15 in the first stop position.

In this instance, as soon as the work is placed in position on the work table 21 through the work entrance 6 of the treating compartment 3, the work entrance 6 is closed with the lid 8.

Indicated at 48 and 49 are work transfer heads which serve to transfer a substrate on a work table to an adjacently located work table.

More specifically, the transfer head 48 on the entrance side (hereinafter referred to as "first transfer head") operates to transfer a substrate 24 from the first work table 21 to the second work table 22, while the transfer head 49 on the exit side (hereinafter referred to as "second transfer head") operates to transfer a substrate 24 from the second work table 22 to the third work table 23.

These work transfer heads 48 and 49 are each in the form of a relatively flat box-like structure having a flat face which is smaller than the faces of the work tables 2 to 23 to a certain extent, and provided with a multitude of small holes in the respective lower walls although not shown in the drawings.

The reference 50 indicates cylindrical linear guides extending in the vertical direction and having the respective upper ends fixed on the top wall 5 of the treating compartment 3 at positions which are in vertical alignment with the centers of the second and third work tables 22 and 23, respectively, when the transfer block 15 is in the first stop position. Separately and slidably fitted in these linear guides 50 are vertical support rods 51 which are moved up and down by air cylinder mechanisms as will be described hereinlater. The above-described transfer heads 48 and 49 are fixedly supported on the lower ends of these support rods 51.

Indicated at 52 are air cylinder mechanisms which are fixedly mounted on the top wall 5 of the treating compartment 3, each having a vertically movable block **52*a* fixedly connected to the upper end of the corresponding support rod 51**.

Accordingly, the two work transfer heads 48 and 49 are independently moved up and down by the respective air cylinder mechanisms 52, between an upper lifted position slightly above the upper surface of the work table 21, 22 or 23 and a lowered position lightly in contact with the upper surface of a substrate 24 on the work table 21, 22 or 23.

The reference 53 denotes flexible air hoses which are in communication at the respective inner ends with the inner spaces of the transfer heads 48 and 49, and passed through holes in the top wall 5 and connected at the outer ends to air compressors (not shown) outside the treating compartment 3.

Although not shown in the drawings, a control valve is inserted in each of the air hoses 53 for selectively feeding or discharging compressed air into or out of the inner spaces of the transfer heads 48 and 49, selectively switching the internal pressures of the transfer heads 48 and 49 to a positive or negative level.

Described below is a piping system for the supply of powder to the mixing tanks 45, for recovery and classification of powder spent by the blast nozzles 38 to 40, for recirculation of collected powder to the mixing tanks 45, and for supply of compressed air to the mixing tanks 45 etc.

The substrates 24 undergoes abrasion treatments with the powder blasts in the manner as follows (see FIGS. 7 through 14).

In an initial phase of operation where the transfer block 15 is in the first stop position, an untreated substrate 24 which has been delivered by the work conveyer belt 47 is placed on the first work table 21 (FIG. 7), and almost simultaneously the first work table 21 is internally depressurized to negative level to hold the work 24 (hereafter a small letter "a" will be attached to the reference numeral of this particular substrate) on the first work table 21 by suction force.

Figure 8:
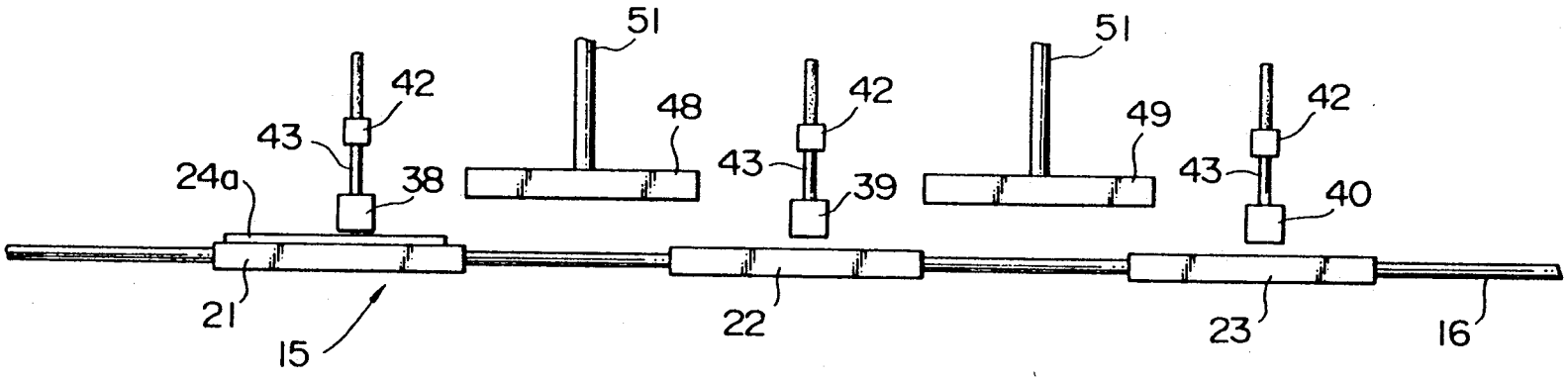
FIG. 8 is a diagrammatic front view of major components in an operational phase in which a substrate on a first work table is undergoing an abrasion treatment by powder mixture blasts.

As soon as the substrate **24*a* is placed in position on the first work table 21, the transfer block 15 is firstly moved to an initial position (hereafter referred to as "treatment-initiating position") where the fore ends of the work tables 21 to 23 are respectively in alignment with the loci of movement of the blast nozzles 38, to 40, and then fed in the forward direction or in a direction toward the exit end of the treating compartment stepwise in a predetermined pitch (over a predetermined distance in each step). In this regard, FIG. 8 shows a state where the transfer block 15** has been moved to a certain extent in the forward direction from the treatment-initiating position.

The pitch of the stepwise forward movements of the transfer block 15 substantially corresponds to the width in the longitudinal direction of the nozzle tips 41 on the blast nozzles 38 to 40, namely, to the width of strips of powder blasts spurted from the blast nozzles 38 to 40.

During the stepwise forward movement of the transfer block 15, the blast nozzles 38 to 40 which are located over the respective work tables 21 to 23 are reciprocated back and forth between a receded position and an advanced position with or without continuing the powder blasting.

The blast nozzles 38 to 40 are reciprocated alternately with one pitch of longitudinal feed of the transfer block 15.

More specifically, as soon as the transfer block 15 comes to the treatment-initiating position, the blast nozzle 38 is moved toward the advanced position from the retracted position (hereinafter this forward movement is referred to as "forward scan"). The transfer block 15 is held at rest during this forward scan of the blast nozzle 38. Upon completion of the forward scan, the blast nozzle 38 is temporarily stopped in the advanced position in stand-by state, while the transfer block 15 is fed in the forward direction by one pitch and, as soon as the transfer block 15 is topped, the blast nozzle 38 is moved back toward the retracted position (hereinafter this rearward movement is referred to as "rearward scan"). Upon completion of the rearward scan, the blast nozzle 38 is temporarily stopped in the retracted position in standby state while the transfer block 15 is fed by one pitch again. Thereafter, the forward and rearward scans are repeated alternately with a stepwise feed of the transfer block 15.

Thus, as the transfer block 15 is fed pitch by pitch repeatedly and alternately with a forward or rearward scan of the blast nozzle 38, mixture powder is blasted against the entire surface of the substrate **24*a*** thereby to form blind holes of a predetermined depth in unmasked portions of the substrate by the abrading action of the mixture powder blasts.

Hereafter, the above-described treatment by the first blast nozzle 38 will be referred to as "first treatment" for the convenience of explanation.

Figure 9:
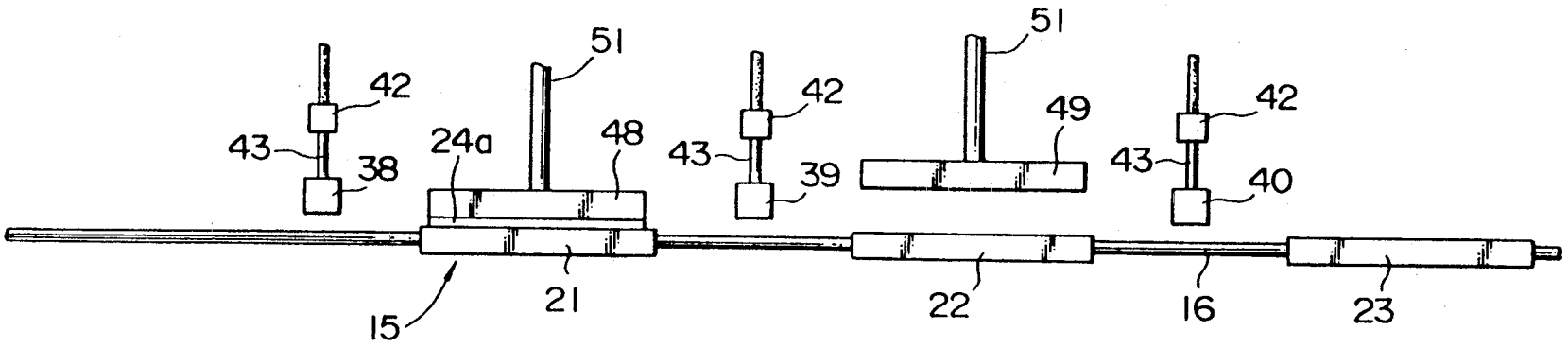
FIG. 9 is a diagrammatic front view of major components in an operational phase in which the substrate on the first work table is being picked up by a first work transfer means.
Figure 10:
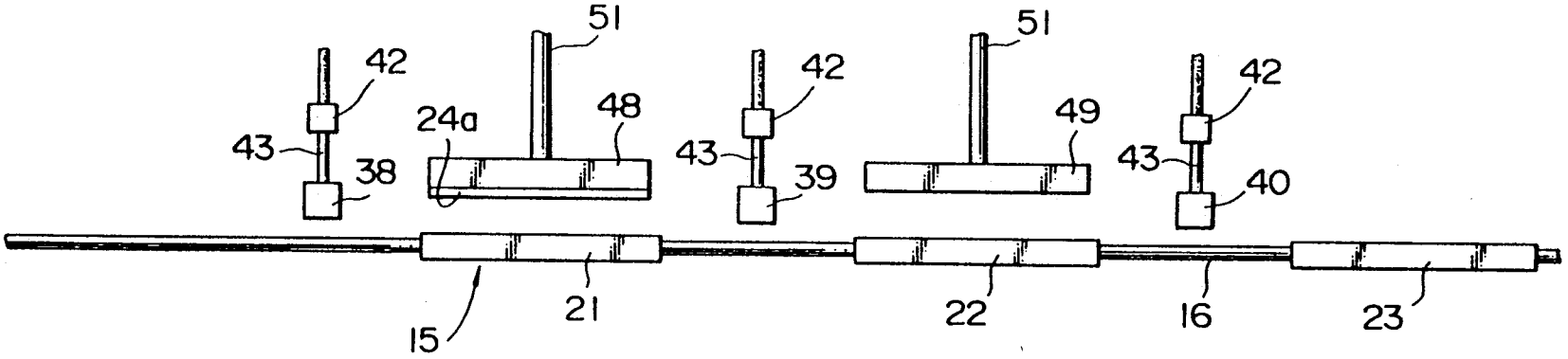
FIG. 10 is a diagrammatic front view of major components in an operational phase in which the substrate is being lifted up from the first work table.

Upon completing the first treatment on the substrate **24*a* by the first blast nozzle 38, the transfer block 15 is moved to the second stop position as shown in FIG. 9, bringing the first to third work tables 21 to 23 into positions confronting the first transfer head 48, second transfer head 49 and the work exit 7**, respectively.

Succeedingly, the first transfer head 48 is moved to the lower position with a substantially simultaneous switch of its internal pressure to negative level thereby to suck the substrate **24*a* on its lower surface (FIG. 9**).

The first transfer head 48 is then lifted up to its upper position (FIG. 10), picking up the substrate **24*a* off the first work table 21**.

Figure 11:
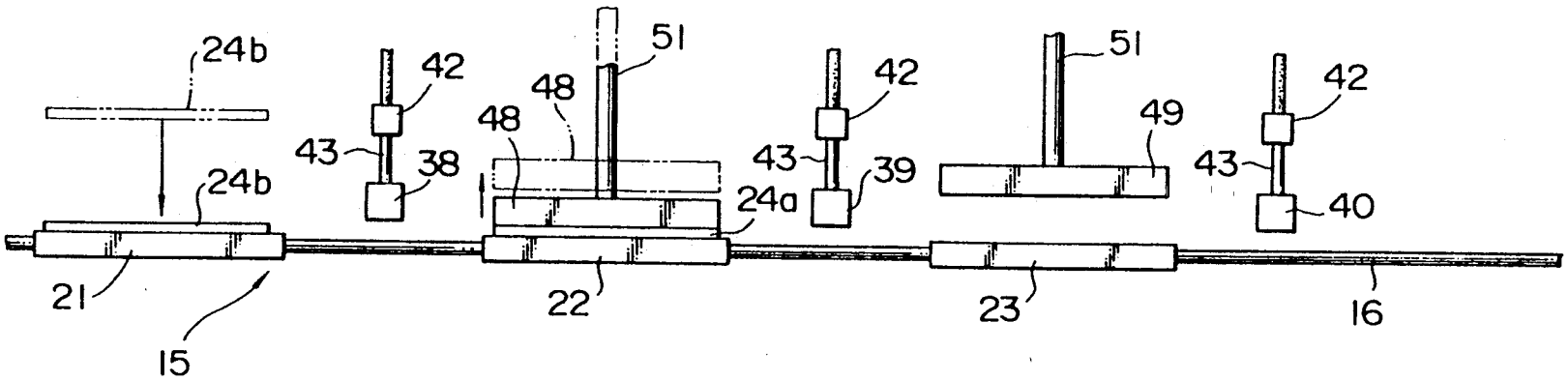
FIG. 11 is a diagrammatic front view of major components in an operational phase in which the substrate is transferred onto the second work table while a fresh substrate is loaded on the first work table.

As soon as the first transfer head 48 is returned to its upper position, the transfer block 15 is moved back to the first stop position as shown in FIG. 11. Consequently, the first to third work tables 21 to 23 are again located in positions confronting the work entrance 6, the first transfer head 48 and the second transfer head 49, respectively.

In this state, a fresh substrate 24 (hereinafter a small letter "b" will be attached to the reference numeral of this particular substrate) is placed on the first work table 21, and the first transfer head 48 is moved to the lower position as indicated by solid line in FIG. 11 while concurrently switching its internal pressure to positive level. Simultaneously, the second work table 22 is internally depressurized to negative level to suck the substrate **24*a*** thereto.

Thereafter, the first transfer head 48 is lifted to the upper position as indicated by two-dot chain line in FIG. 11.

As a result, the fresh substrate **24*b* is placed on the first work table 21, and the substrate 24*a* which has undergone the first treatment is placed on the second work table 22**.

Figure 12:
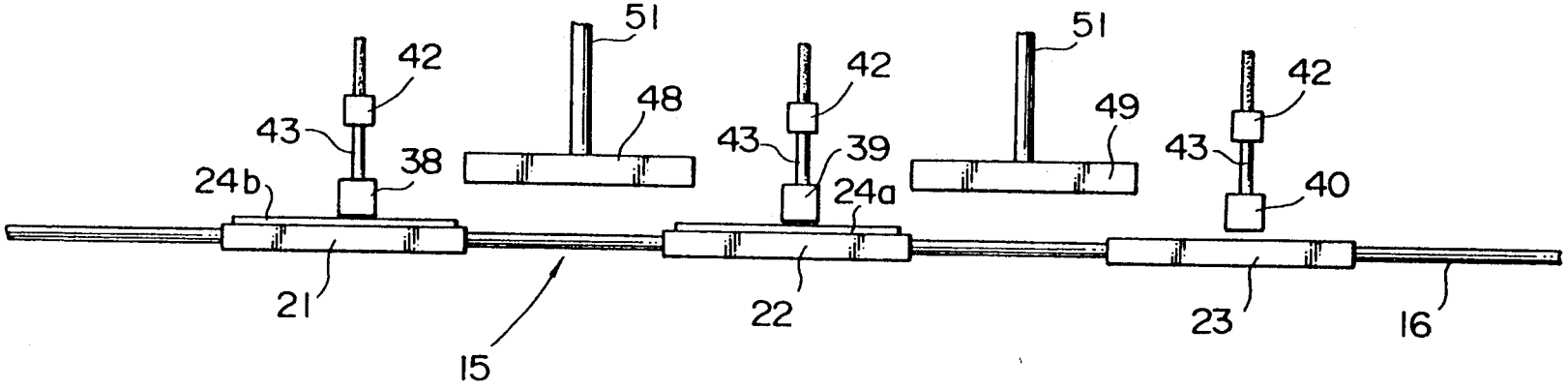
FIG. 12 is a diagrammatic front view of major components in an operational phase in which the substrates on the first and second work tables are simultaneously and separately undergoing an abrasion treatment with powder blasts.
Figure 13:
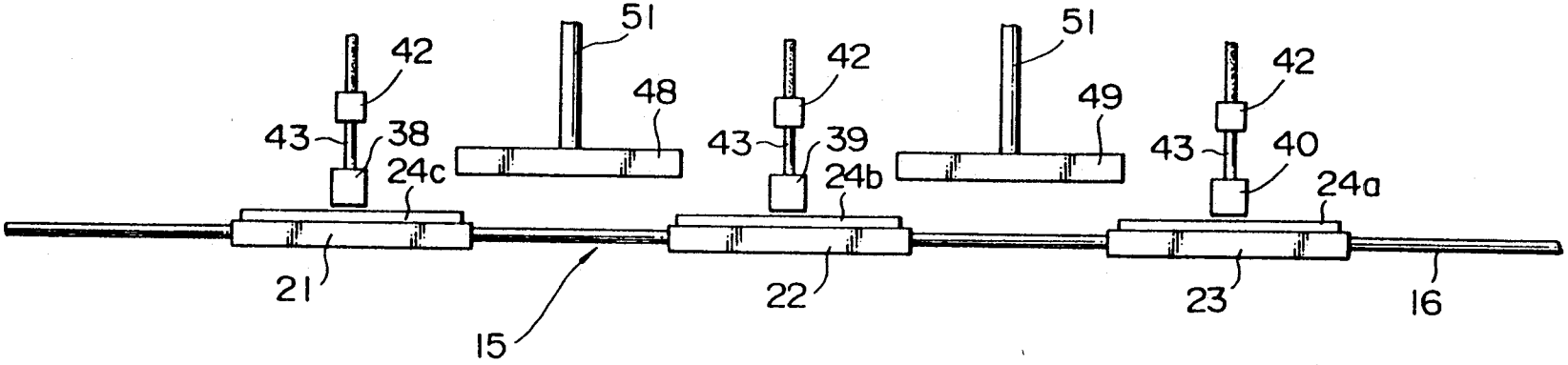
FIG. 13 is a diagrammatic front view of major components in an operational phase in which the substrates on three work tables are simultaneously and separately undergoing an abrasion treatment with powder blasts.

Nextly, the transfer block 15 is moved to the treatment-initiating position to initiate therefrom the above-described stepwise feed of the transfer block 15 and scans of the substrate **24*b* by the first blast nozzle 38, simultaneously with scans of the substrate 24*a* by the second blast nozzle 39 (see FIG. 12). In these concurrent treatments, the substrate 24*b* is subjected to the first treatment while the substrate 24*a*** is subjected to another treatment with powder blasts to further deepen a selected one or ones of blind holes which should have a greater depth or which should be perforated into through holes in the final stage.

More specifically, the scans toward and away from the substrate board **24*a* by the second blast nozzle 39 are effected concurrently with the scans by the first blast nozzle 38. However, in this instance arrangements are made such that the powder blasts are spurted from the second blast nozzle 39 only when the nozzle 39 is in a position confronting a blind hole to be deepened further after the scans by the first blast nozzle 38 or in a position confronting a blind hole which is to be completely perforated in the end. For this purpose, the powder blasting by the second blast nozzle 39 is controlled by turning on and off a fluid valve (not shown) which is inserted in the air feed tube 45 leading to the second blast nozzle 39**.

For the convenience of explanation, the above-described treatment by the second blast nozzle 39 is hereafter referred to as "second treatment".

Upon completing the treatments on the substrates **24*a* and 24*b* in this manner, the transfer block 15 is advanced to the second stop position, and simultaneously the two transfer heads 48 and 49 are moved to the respective lower positions. During this downward movement, the transfer heads 48 and 49 are internally depressurized to negative level, while the internal pressures of the first and second work tables 21 and 22 are switched to positive level. Consequently, the substrates 24*b* and 24*a* are sucked on the first and second transfer heads 48 and 49**, respectively.

Then, the transfer heads 48 and 49 are returned to the respective upper lifted positions, picking up the substrates **24*a* and 24*b* off the work tables 21 and 22, respectively, and in the next phase of operation the transfer block 15** is moved back toward the first stop position.

In the first stop position, a fresh substrate 24 (a small letter "c" will be attached to the reference numeral of this particular substrate) is placed on the first work table 21, and simultaneously the transfer heads 48 and 49 are moved to the respective lower positions. At this time point, the internal pressures of the transfer heads 48 and 49 are switched to positive level, and concurrently the second and third work tables 22 and 23 are internally depressurized to negative level to hold the substrates **24*b* and 24*a*** separately thereon by suction force.

In the next place, after the transfer heads 48 and 49 are returned to the respective upper lifted positions, the transfer block 15 is advanced to the treatment-initiating position, restarting therefrom the above-described stepwise feed of the transfer block 15 alternately with a scan of the substrate **24*c* by the first blast nozzle 38, a scan of the substrate 24*b* by the second blast nozzle 39 and a scan of the substrate 24*a* by the third blast nozzle 40 (see FIG. 13), thereby effecting the first treatment on the substrate 24*c* and the second treatment on the substrate 24*b* while effecting a further powder blasting treatment on selected ones of the blind holes on the substrate 24*a*** to perforate them into through holes.

More specifically, the third blast nozzle 40 is operated to scan the substrate **24*a* concurrently with the scanning operations by the first and second blast nozzles 38 and 39. Similarly to the second blast nozzle 39, the powder blasting by the third blast nozzle 40 is turned on only when the third blast nozzle 40 comes to a position where it confronts a blind hole which is to be ultimately perforated into a through hole. By this further treatment with powder blasts, such a blind hole is dug deeper and deeper until its bottom reaches the lower surface of the substrate 24**, namely, until a through hole is opened there.

The treatment by the third blast nozzle is hereafter referred to as "third treatment" for the convenience of explanation.

In this manner, while the first treatment completes an operation of forming relatively shallow blind holes on a substrate 24, concurrently the second treatment deepens the blind holes in predetermined positions on a substrate and the third treatment further digs selected ones of the deepened blind holes to open through holes there.

Figure 14:
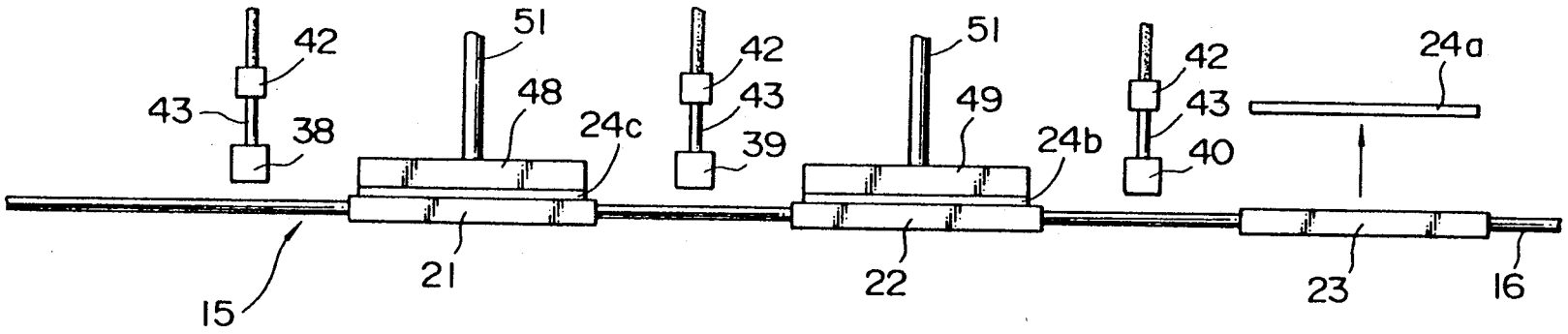
FIG. 14 is a diagrammatic front view of major components in an operational phase in which the substrates on the first and second work tables are being sucked onto the first and second work transfer means, respectively, while the substrate on the third work table is being ejected from the third work table.

Nextly, as shown in FIG. 14, the transfer block 15 is moved to the second stop position and at the same time the transfer heads 48 and 49 are lowered to suction thereto the substrates **24*c* and 24*b*, respectively. Concurrently, the substrate 24*a* on the third work table 23 is picked up conveyer belt 47 through the work exit 7 of the treating compartment 3**.

Finally, after the transfer heads 48 and 49 are lifted to the respective upper positions, the transfer block 15 is returned to the first stop position to receive a fresh substrate 24 on the first work table 21 while transferring the substrates **24*c* and 24*b* onto the second and third work tables 22 and 23**, respectively. Thereafter, the above-described operations for the first, second and third treatments are cyclically repeated.

Thus, the substrates are concurrently and successively subjected to a number of different treatments in the above-described manner.

Accordingly, the substrates 24 which have undergone the powder blasting treatments (the first to third treatments) by the blast nozzles are successively ejected from the powder blasting apparatus 1 at the same time intervals as the intermittent reciprocating movements of the transfer block 15 between the first and second stop positions.

Figure 15:
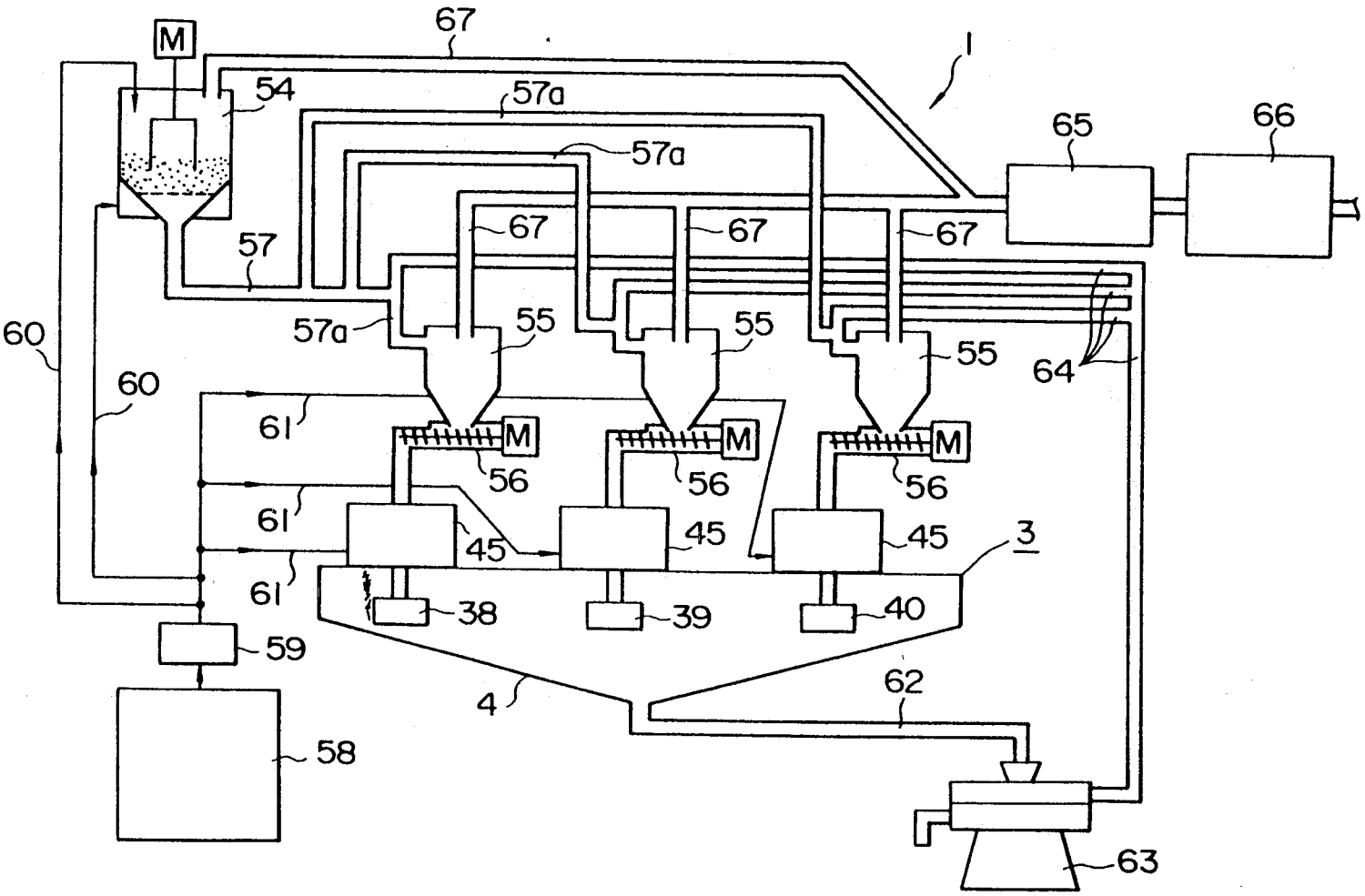
FIG. 15 is a diagrammatic illustration of a piping system.

Referring now to FIG. 15, there are shown major components of a piping system suitable for the above-described powder blasting apparatus 1.

In this figure, indicated at 54 is a powder feed tank which stores a large quantity of fine powder, at 55 are hoppers for introduction of powder material, and at 56 are screw conveyers which are connected to the lower ends of the hoppers 55. Extended from the lower end of the powder feed tank 54 is a powder feed pipe 57 which is divided into three branch pipes **57*a* separately leading to the above-mentioned hoppers 55**.

Indicated at 58 is an air compressor serving to produce compressed air of high pressure, which is passed through a drier 59 for moisture removal and partly supplied to the powder feed tank 54 through air pipes 60 to feed the powder in the tank 54 to the respective hoppers 55 along with the compressed air through the branch pipes **57*a*. From the hoppers 55, the supplied powder is introduced into the mixing tanks 45 by the respective screw conveyers 56**.

Part of the compressed air from the drier 59 is also fed to the mixing tanks 45 through air pipes 61 and mixed with the fine powder in the respective tanks 45 prior to supply to the blast nozzles 38 to 40.

Indicated at 62 is a collecting pipe which has one end thereof connected to suction ports **4*b* of the treating compartment 3. The other end of the collecting pipe 62 is connected to a classifier 63. The spent fine powder in the treating compartment 3 is collected in the classifier 63 through the collecting pipe 62, and, after classifying the powder according to particle size in the classifier 63, only fine powder in a predetermined range in particle size is returned to the hoppers 55 through recirculation pipes 64 to serve again for the powder blasting treatments on the substrates 24**.

Denoted at 65 is an air exhauster, and at 66 is a dust strainer which is connected to dust collector pipes 67 from the powder feed tank 54 and the respective hoppers 55. Extremely fine powder, which has mingled into the powder feed tank 54 and hoppers 55, is removed at the dust strainer 55 under the influence of the suction force of the air exhauster 65, discharging to the outside clean air only.

Further, the converging bottom ends of the dust collector hoods 27 are respectively connected to the classifier 63 through dust collector hoses which are not shown, thereby to collect major part of spent powder, which has been blasted against substrates 24 by the blast nozzles 38 to 40, for recovery to the classifier 63 through the dust collecting hoods 27.

As clear from the foregoing description, the powder blasting apparatus according to the invention is provided with: a plural number of work tables arrayed at uniform intervals in the longitudinal direction of the apparatus and arranged to releasably hold a work thereon independently of each other; a work table feed means arranged to reciprocate the work tables simultaneously in the longitudinal direction between first and second stop positions across a distance corresponding to the intervals between the work tables; blast nozzles each arranged to blast a mixture of high pressure gas and fine powder against a work on a confronting work table at a position intermediate between the first and second stop positions; and a work transfer means arranged to pick up a work on a first one of two adjacent work tables and to place the work on the other or second work table; the work transfer means being located in a position corresponding to the second stop position of the first work tables as well as to the first stop position of the second work table; the blast nozzles being located between the first and second stop positions of the respective work tables; the powder blasting machine being adapted to operate in a sequence of loading a work on the first work table at the first stop position, feeding the work tables forward from the first to second stop position by the work table feed means while subjecting the work to an abrasion treatment with blasts of powder mixture from a blast nozzle at a point intermediate between the first and second stop positions, picking up the work off the first work table by the work transfer means at the second stop position, placing the work on the second work table as soon as the work tables are returned to the first stop position, and feeding the work tables again toward the second stop position while subjecting the work to another abrasion treatment at a point intermediate between the first and second stop positions, thereby transferring the work successively to adjacently located tables while subjecting same successively and progressively to different abrasion treatments by the respective blast nozzles.

Thus, the powder blasting apparatus is capable of giving different treatments concurrently by the respective blast nozzles, for example, by varying the blasting time or range of the powder, the kind of the powder or blast pressure from nozzle to nozzle. Namely, a number of different types of holes can be formed on a substrate by suitably setting these operational factors respectively for the blast nozzles. Besides, after feeding untreated substrates to the powder blasting apparatus, the substrates are successively formed with predetermined holes and ejected from the apparatus at the same time intervals as the transfer of works from one work table to another by the work transfer means. Accordingly, substrates, finished with the boring and perforating treatments, are successively discharged from the apparatus in the same timing, shortening the so-called tact time to a marked degree.

In the foregoing embodiment, the invention is applied to a powder blasting apparatus which is arranged to form in each substrate two kinds of blind holes of different depths along with through holes. However, the invention can be applied a case where three or more kinds of blind holes are to be formed. In such a case, a greater variety of holes can be easily formed by correspondingly increasing the number of the blast nozzles, that is to say, the number of steps of treatment.

In the foregoing embodiment, the powder blasting apparatus is arranged to scan the entire surface of a work by the blast nozzle to direct the powder blasts toward necessary work areas in each treatment. Alternatively, it is possible to preset the scan range of each blast nozzle to direct the powder blasts only to a range where blind or through holes are to be formed.

Further, it is conceivable to form blind and through holes by employing different combinations of powder grain sizes and blast pressures in the respective stages of the treatment.

Moreover, although the powder blasting apparatus of the above-described embodiment is adapted for the operation of forming blind and through holes in substrates, the application of the present invention is not restricted to works of this sort.

It is to be understood that the particular forms and arrangements shown in the above embodiment are shown by way of example only and should not be construed as limitative elements in carrying out the powder blasting apparatus of the invention.

What is claimed is:

1. A powder blasting apparatus for abrasion treatments, comprising:

a plural number of work tables located at uniform intervals in the longitudinal direction of said powder blasting apparatus and arranged to releasably hold a work independently of each other;

a work table feed means arranged to reciprocate said work tables simultaneously in the longitudinal direction between first and second stop positions across a distance corresponding to the intervals between said work tables;

blast nozzles each arranged to blast a mixture of high pressure gas and fine powder against a work on a confronting work table which table is located at a position between said first and second stop positions; and a work transfer means arranged to pick up a work on first one of two adjacent work tables and to place said work on the second of the two adjacent work tables;

said work transfer means being located in a position corresponding to the second stop position of said first work table as well as to the first stop position of the second work table;

said blast nozzles being located between the first and second stop positions of the respective work tables; and said powder blasting machine being adapted to operate in a sequence of loading a work on said first work table at said first stop position, feeding said work tables forward from said first to second stop position by said work table feed means to subject said work to an abrasion treatment with blasts of powder mixture from a blast nozzle at a point intermediate between said first and second stop positions of said first work table, picking up said work by said work transfer means at said second stop position, placing said work on said second work table as soon as said work tables are returned to said first stop position, and feeding said work tables again toward said second stop position to subject said work to another abrasion treatment at a point intermediate between said first and second stop positions, thereby transferring sad work successively to adjacently located tables while subjecting same successively and progressively to different abrasion treatments by said blast nozzles.

2. A powder blasting apparatus as defined in claim 1, wherein said work tables are each fed stepwise in a predetermined pitch toward said second stop position from a treatment initiating point, and said blast nozzle are each provided with a nozzle tip with a spout mouth having a length substantially corresponding tot he pitch of said stepwise feed of said work tables in said longitudinal direction.

3. A powder blasting apparatus as defined in claim 2, wherein said blast nozzles are supported on retractable nozzle supports and arranged to make a scan across the surface of a work alternately with one pitch of forward feed of said work tables.

4. A powder blasting apparatus as defined in claim 2, wherein said work tables and work transfer means are connected to a pressure regulator and thereby internally depressurized a the time of holding a work.

5. A powder blasting apparatus as defined in claim 2, further comprising a treating compartment housing therein said work tables and said blast nozzles and having a work entrance and a work exit opened in the opposite longitudinal end portions thereof.

6. A powder blasting apparatus as defined in claim 1, wherein said work tables and work transfer means are connected to a pressure regulator and thereby internally depressurized at the time of holding a work.

7. A powder blasting apparatus as defined in claim 1, further comprising a treating compartment housing therein said work tables and said blast nozzles and having a work entrance and a work exit opened in the opposite longitudinal end portions thereof.

8. A powder blasting apparatus as defined in claim 7, wherein said work tables are fixedly supported on a transfer block for reciprocating movement within said treating compartment.

9. A powder blasting apparatus as defined in claim 8, wherein said transfer block induces a plurality of slide shafts extended longitudinally through the opposite end walls of said treating compartment, and a plurality of guide shafts extended longitudinally through said treating compartment to guide the reciprocating movements of said slide shafts.

10. A powder blasting apparatus as defined in claim 9, further comprising a plurality of powder collecting hoods fixedly attached to said slide shafts in such a manner as to each enclosure one of the work tables, said collecting hoods being disposed beneath said work tables and each provided with a suction port in the bottom wall thereof to collect spent powder from said blast nozzles.

11. A powder blasting apparatus as defined in claim 10, further comprising a piping system including a powder supply circuit containing a powder source and a compressed air source and connected to said blast nozzles, and a powder collecting circuit connected to said suction ports of said powder collecting hoods.

* * * * *